US010711984B2

(12) United States Patent
Mullen

(10) Patent No.: US 10,711,984 B2
(45) Date of Patent: Jul. 14, 2020

(54) LANDSCAPE LIGHTING FIXTURE AND MOUNT SYSTEM

(71) Applicant: Nate Mullen, Valley Center, CA (US)

(72) Inventor: Nate Mullen, Valley Center, CA (US)

( * ) Notice: Subject to any disclaimer, the term of this patent is extended or adjusted under 35 U.S.C. 154(b) by 0 days.

(21) Appl. No.: 16/219,634

(22) Filed: Dec. 13, 2018

(65) Prior Publication Data

US 2020/0191366 A1 Jun. 18, 2020

(51) Int. Cl.

| | |
|---|---|
| ***F21V 21/08*** | (2006.01) |
| ***F21V 27/02*** | (2006.01) |
| ***F21V 21/06*** | (2006.01) |
| ***F21V 21/116*** | (2006.01) |
| ***F21V 27/00*** | (2006.01) |
| *F21W 131/10* | (2006.01) |

(52) U.S. Cl.

CPC ..... *F21V 21/0824* (2013.01); *F21V 21/06* (2013.01); *F21V 21/116* (2013.01); *F21V 27/005* (2013.01); *F21V 27/02* (2013.01); *F21W 2131/10* (2013.01)

(58) Field of Classification Search

CPC ..... F21V 21/0824; F21V 21/06; F21V 27/005
See application file for complete search history.

(56) References Cited

U.S. PATENT DOCUMENTS

| | | | | |
|---|---|---|---|---|
| 6,910,918 | B1 * | 6/2005 | Driver | F21V 21/002 362/153.1 |
| 2007/0091585 | A1 * | 4/2007 | Hedman | B05B 17/08 362/96 |
| 2009/0122564 | A1 * | 5/2009 | Beadle | F21S 8/081 362/431 |
| 2009/0323339 | A1 * | 12/2009 | Janos | F21V 21/29 362/249.1 |
| 2017/0089509 | A1 * | 3/2017 | Bailey | F16B 7/182 |
| 2017/0198887 | A1 * | 7/2017 | Veloskey | F21V 17/02 |
| 2018/0073709 | A1 * | 3/2018 | Enck, Sr. | F21V 21/0824 |

* cited by examiner

*Primary Examiner* — Alexander K Garlen
*Assistant Examiner* — Eric T Eide
(74) *Attorney, Agent, or Firm* — Kelly & Kelley, LLP

(57) ABSTRACT

A light fixture ground stake that includes a slotted opening through the base disk and central neck. The slotted opening allows for installation of a light fixture with connected electrical wires without the need to pass the wires through the stake before connecting the electrical wires to both the fixture and an electrical source. In addition, a broken stake can be replaced with a new stake without the need to cut or disconnect the electrical wires.

12 Claims, 12 Drawing Sheets

LANDSCAPE LIGHTING FIXTURE AND MOUNT SYSTEM

BACKGROUND OF THE INVENTION

The present invention is directed to a lighting stake primarily for use with landscape lighting fixtures and mounting systems. More particularly, the lighting stake is designed for insertion into the ground and supporting a light fixture at or above ground level. In addition, the lighting stake has structural features that facilitate removal and replacement of the lighting stake without the need to cut exiting electrical connections.

Prior art lighting stakes typically include a rigid spike to fix the stake into the ground and a flat disk designed to be flush with ground level. Prior art lighting stakes are of such a design that connection of the same to a light fixture generally requires that the light fixture and ground stake be connected before running any electrical wires. A pass-through is usually provided through the center of the disk to allow electrical wires to be passed through from beneath the disk to above to disk. It is by this pass-through that a light fixture mounted on the prior art lighting stake is connected to an electrical source.

In such prior art stakes, the pass-through is a closed channel that require a free end of the electrical wires to be fed through the opening prior to making electrical connections. By the same token, if an existing lighting stake needs to be replaced because it is broken or the style is being replaced, the electrical connections need to be disconnected. Where the electrical connections is by an uninterrupted wire, such process more often than not requires cutting the wires and then rejoining the wires using wire connectors or similar structures. Such connections introduce possible points of failure, i.e., water intrusion, or a place for undesired voltage drop.

Accordingly, there is a need for an improved lighting stake that facilitates installation and/or replacement of an existing lighting stake without the need for cutting or otherwise disconnecting electrical wires to a light fixture. A new ground stake should allow for repair and replacement of the ground stake without the need to cut or remove electrical connections. The present invention fulfills these needs and provides other related advantages.

SUMMARY OF THE INVENTION

The present invention is directed to a lighting stake having an elongated spike body with an upper end and a lower end, the lower end configured for insertion into a substrate. A base disk is affixed to the upper end of the spike body. A hollow central neck defines a passageway through the base disk and a part of upper end of the spike body. A slotted opening extends through the base disk and hollow central neck providing lateral access to the passageway.

The central neck preferably has an upper neck portion and a lower neck portion. The lower neck portion is treaded. A stem nipple may be removably affixed in the hollow central neck. The stem nipple is preferably configured to receive a stem body as on a light fixture. The lighting stake may also include a spacer collar removably disposed within the hollow central neck and coaxially disposed around the stem nipple. The spacer collar and stem nipple define an annular space there between configured to receive the stem body.

The spike body preferably has a plurality of ribs having a decreasing width from the upper end to a point at the lower end. Each of the plurality of ribs on the spike body comprises an offset proximate to the lower end that increases the width of each of the plurality of ribs before resuming the decreasing width.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
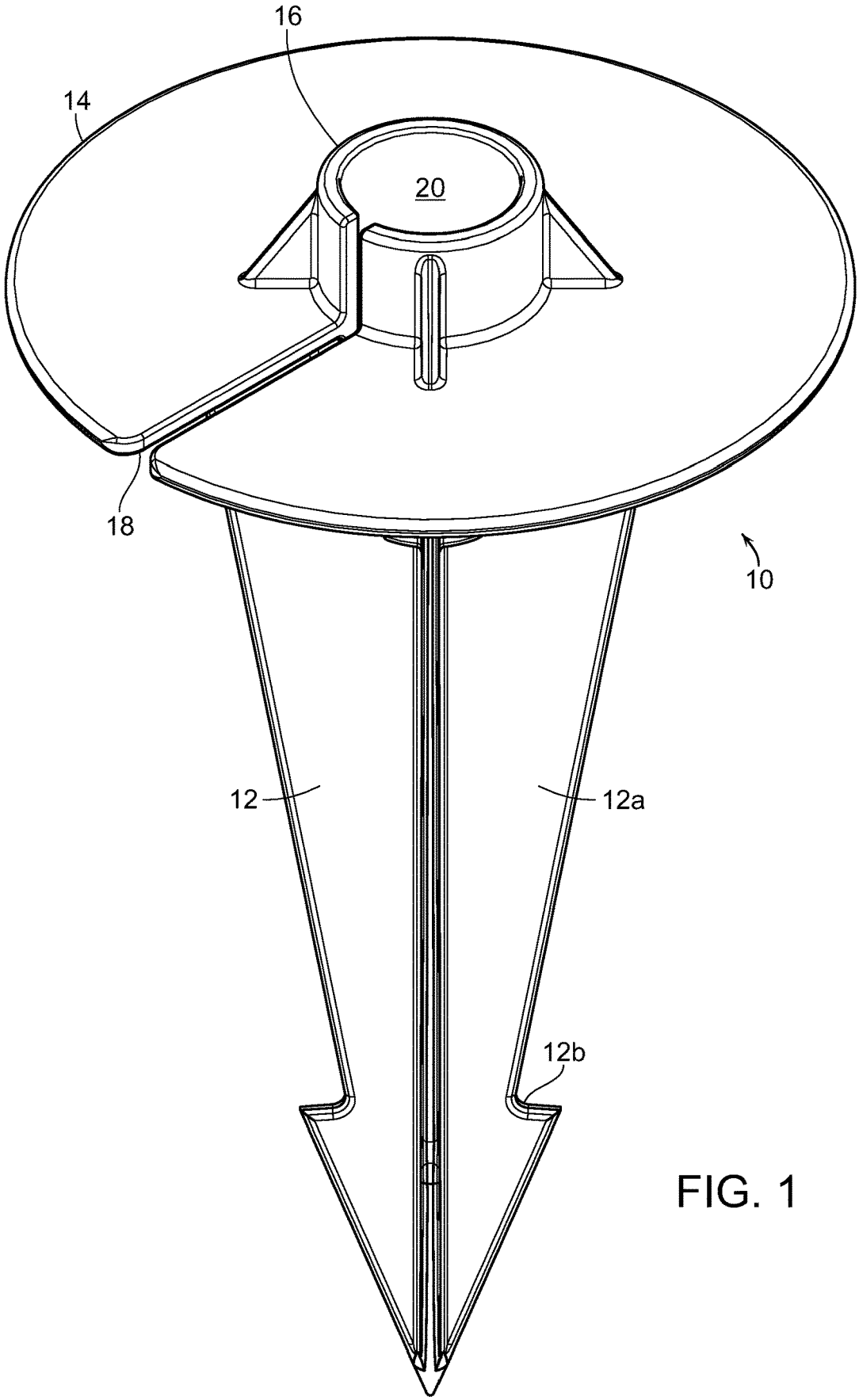
FIG. 1 is a perspective view of an inventive lighting stake according to the present invention.
Figure 2:
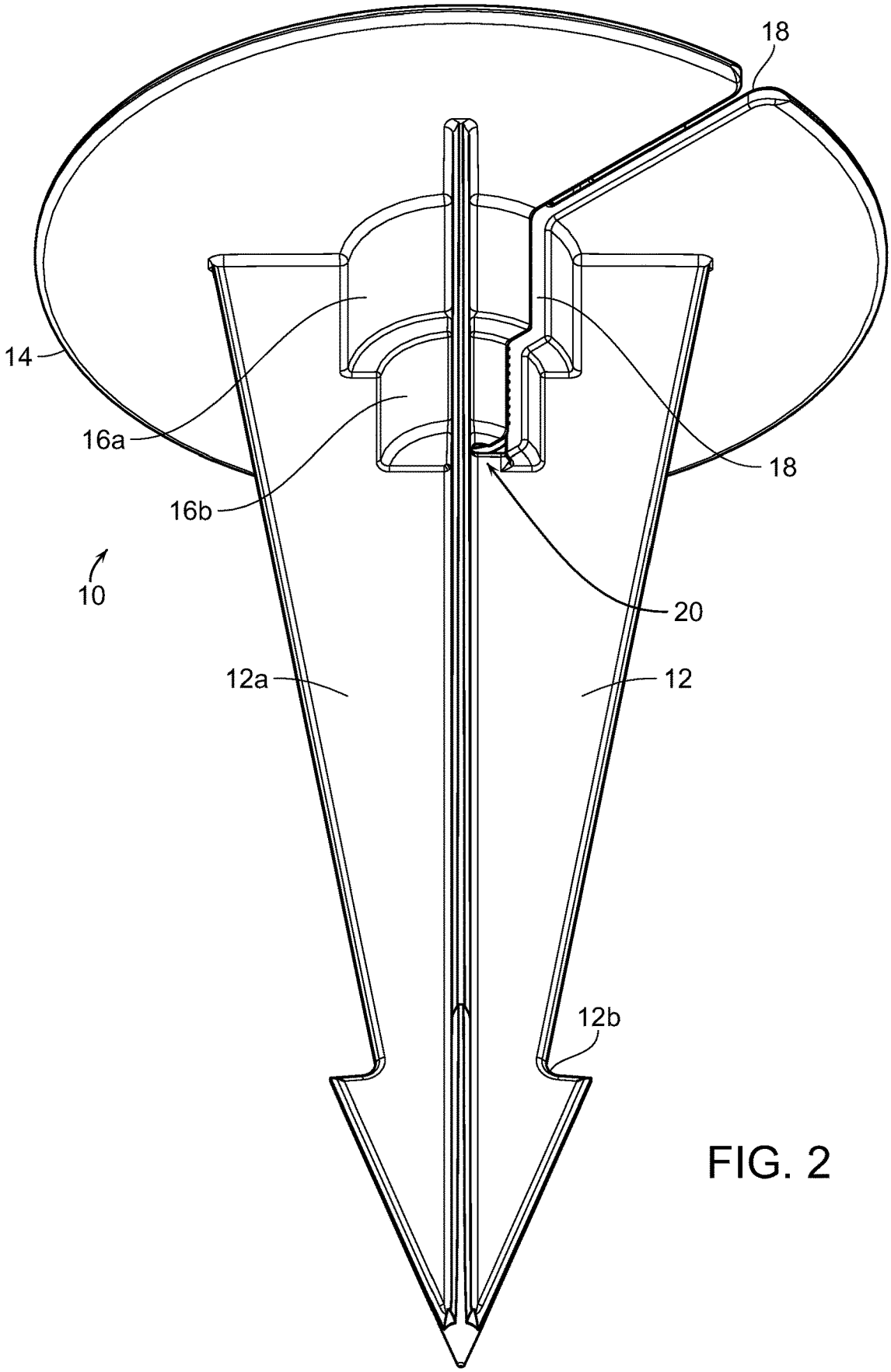
FIG. 2 is lowered perspective view of an inventive lighting stake according to the present invention.
Figure 3:
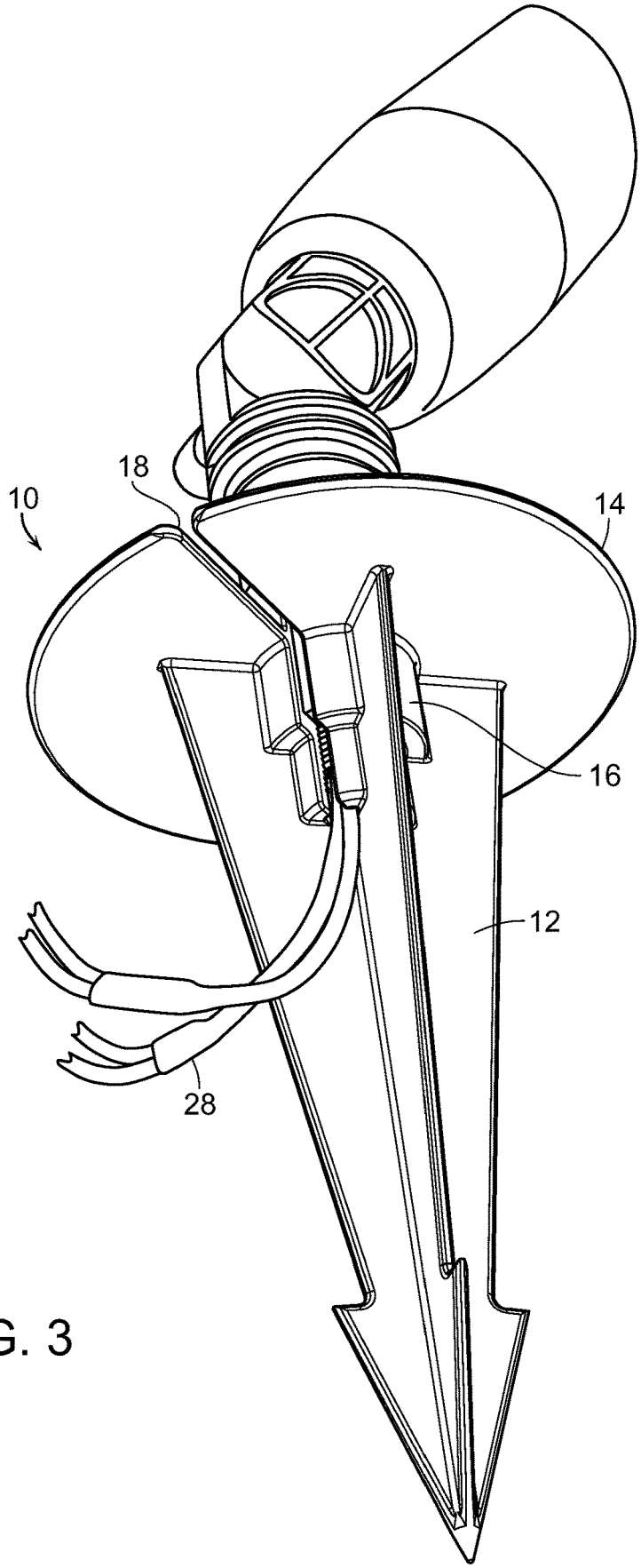
FIG. 3 is a lowered perspective view of an inventive lighting stake according to the present invention including a light fixture.
Figure 4:
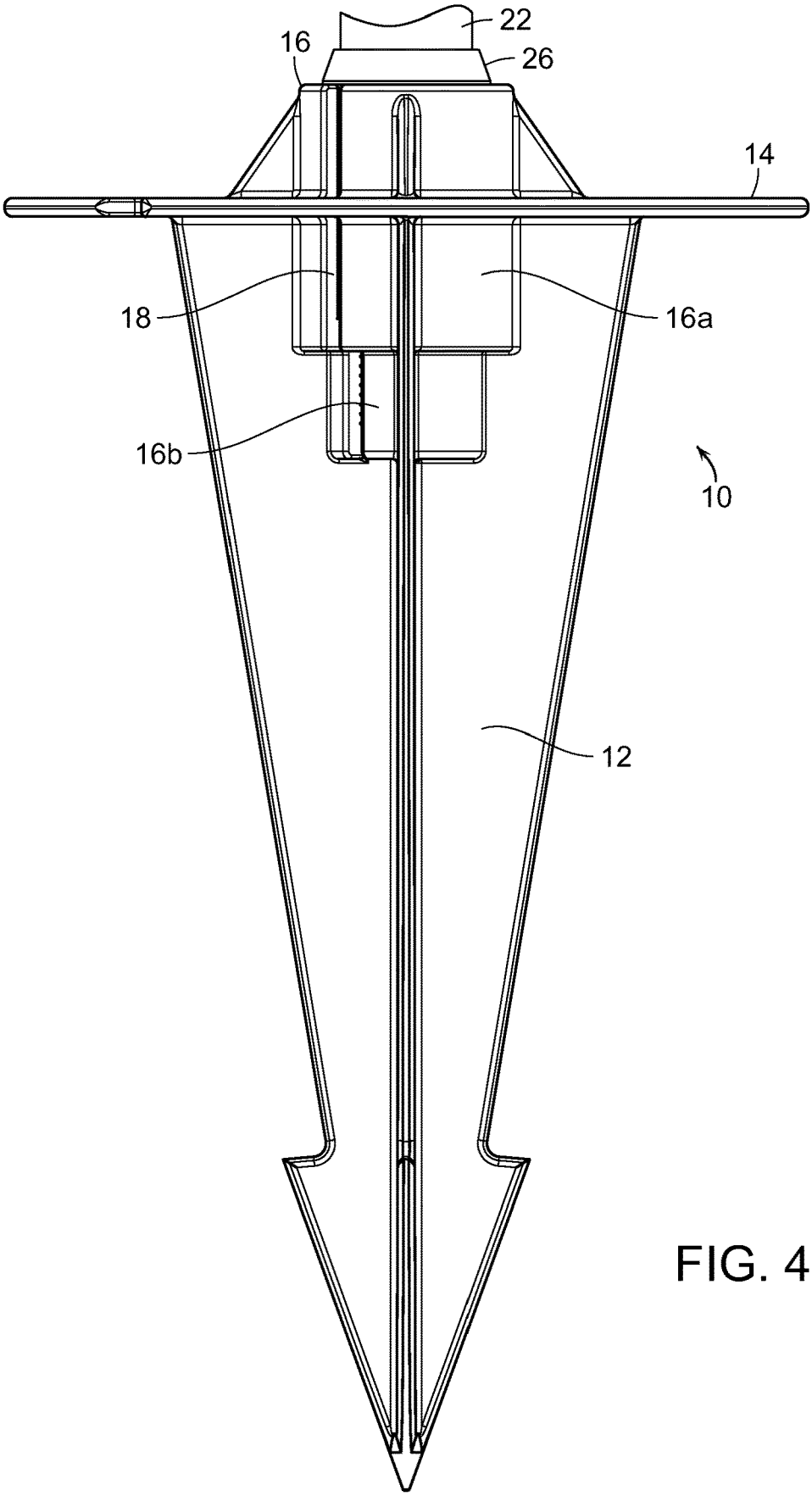
FIG. 4 is side view of an inventive lighting stake according to the present invention.

The present invention is directed to an improved lighting stake and mount. In the following detailed description, the improved lighting stake will be generally referred to by reference numeral 10. FIGS. 1-5 generally show the lighting stake 10 from different angles. The lighting stake 10 generally comprises a spike body 12, a base disk 14, and a central neck 16. The base disk 14 and central neck 16 have a slotted opening 18 that provides access to a pass-through opening 20 through the central neck 16.

The spike body 12 comprises two or more ribs 12*a* that provide a surface area against which earth or other substrate (not shown) can exert supporting forces. Preferably the spike body 12 comprises three to four ribs 12*a* to provide supporting forces in intersecting planes so as to provide the lighting stake 10 with greater stability. The ribs 12*a* may also include a notch or offset point 12*b* to provide a leverage surface to resist removal of the spike body 12 from the earth or other substrate holding the stake 10. The notch or offset point 12*b* acts to counter withdrawal of the spike body 12 from the earth.

Figure 5:
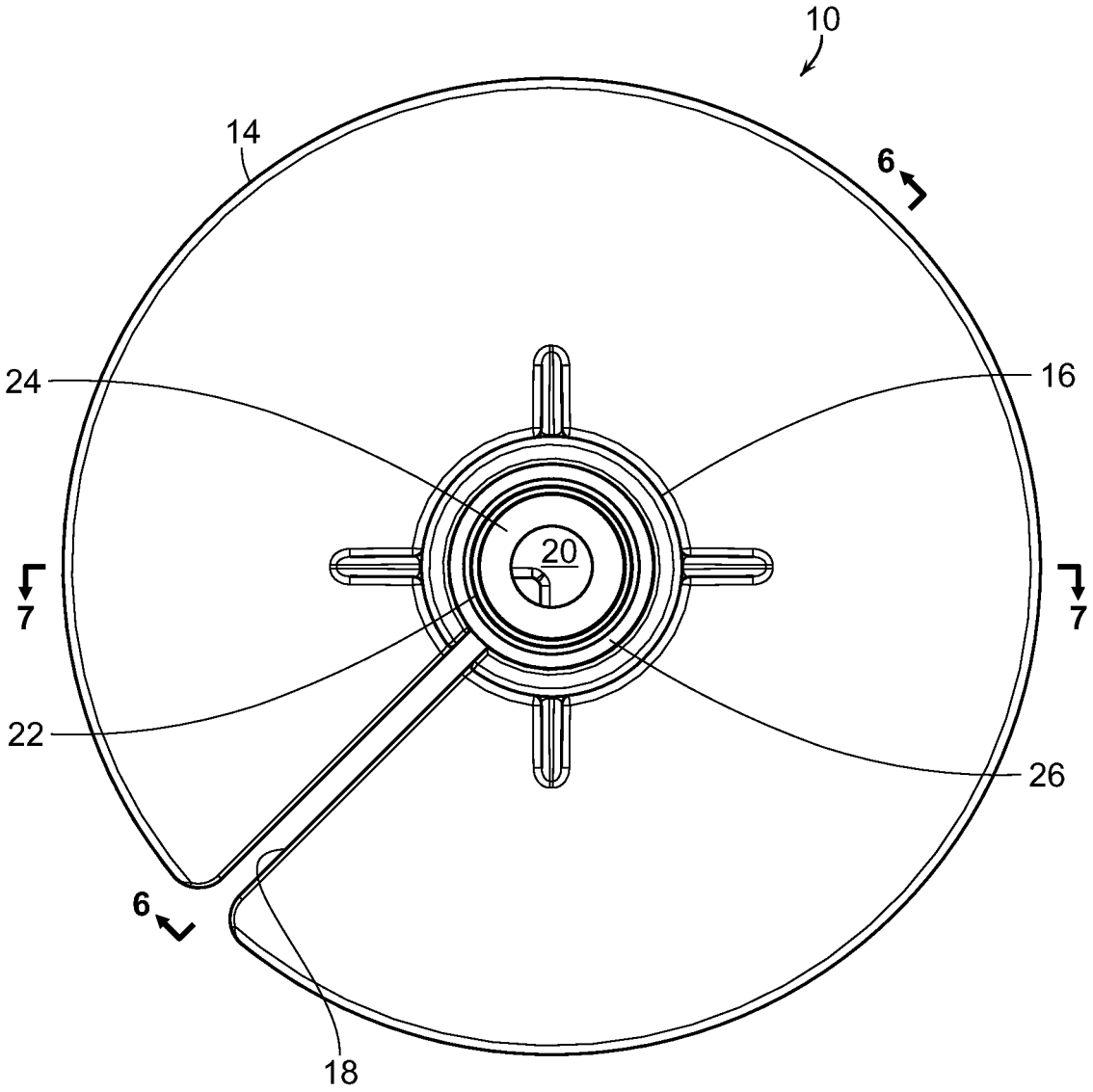
FIG. 5 is a top view of an inventive lighting stake according to the present invention.
Figure 6:
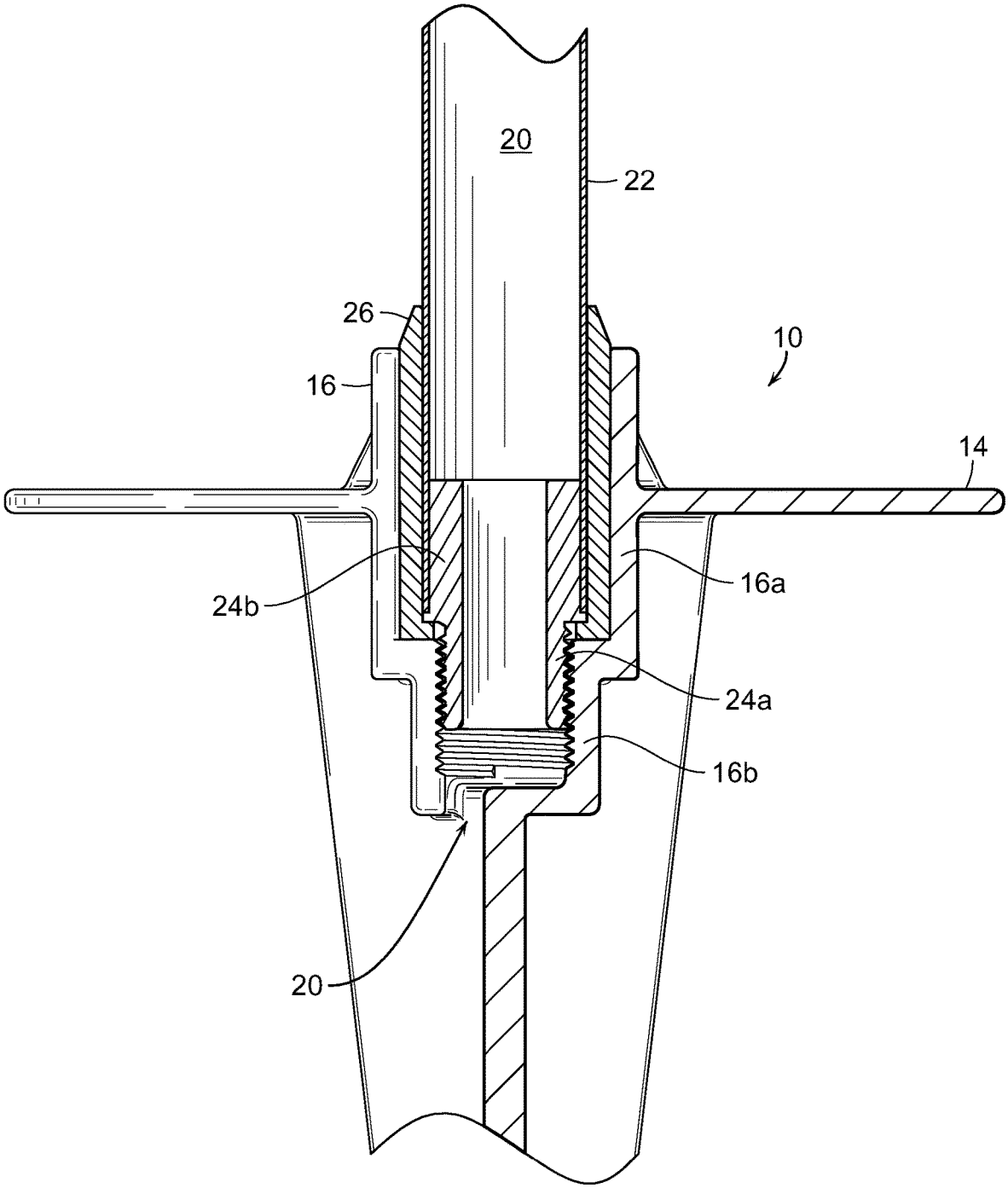
FIG. 6 is a cross-sectional view of an inventive lighting stake according to the present invention taken along line 6-6 of FIG. 5.
Figure 7:
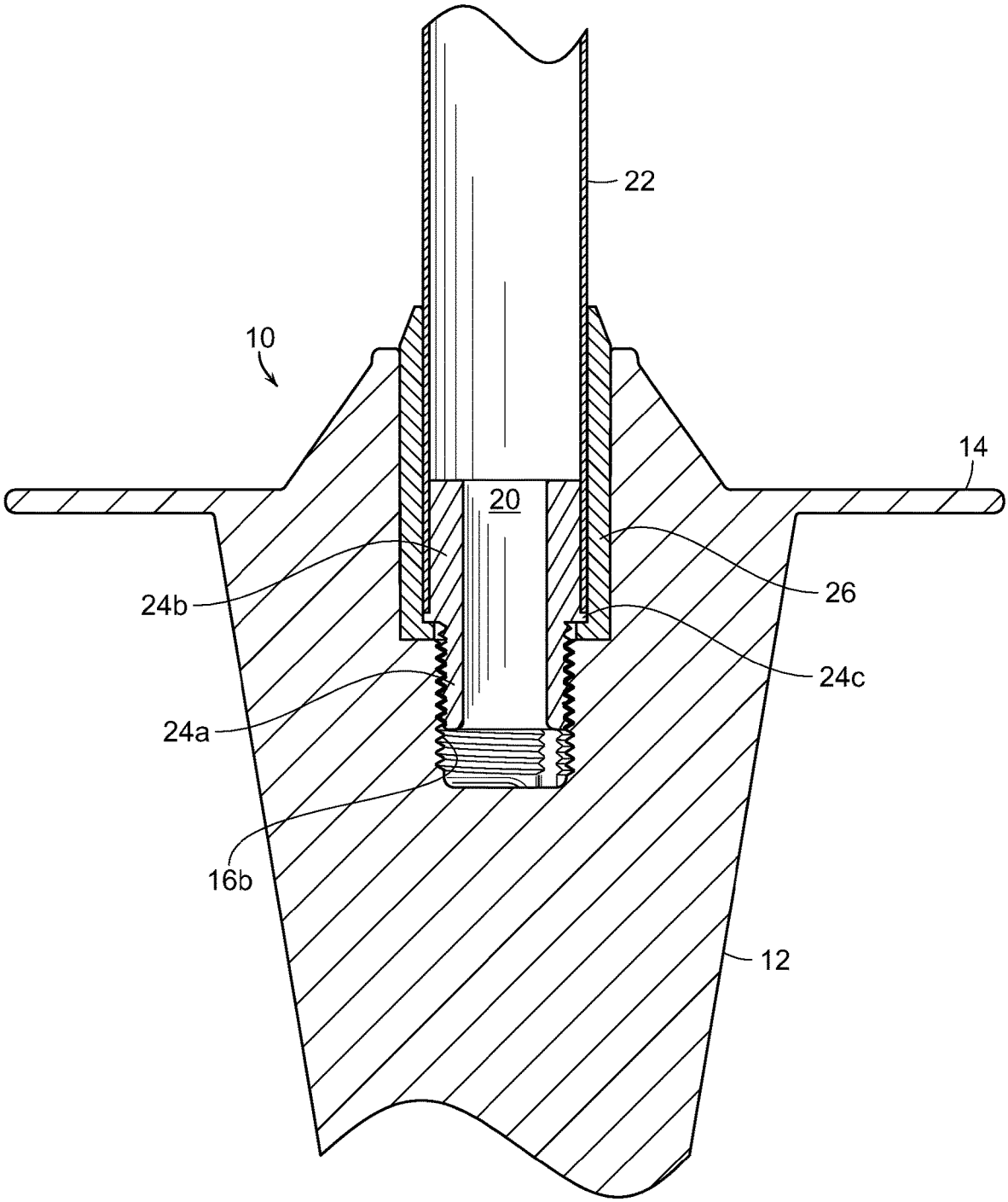
FIG. 7 is a cross-sectional view of an inventive lighting stake according to the present invention taken along line 7-7 of FIG. 5.

As shown in FIGS. 5-7, the central neck 16 is preferably cylindrical in shape, or closely approximating a cylinder, so as to be receptive to a typical stem 22 as might be used on a light fixture (not shown). The central neck 16 preferably has a wide upper portion 16*a* that passes through the center of the base disk 14 and a narrow lower potion 16*b* that is disposed immediately below the upper portion 16*a*. The lower portion 16*b* is preferably provided with threads so as to receive a stem nipple 24 with a threaded base 24*a* matching the threads in the lower portion 16*b*.

The stem nipple 24 preferably has an upper portion 24*b* designed for reception within a hollow collar 22*a* on the stem 22. The stem nipple 24 may include a shoulder 24*c* between the threaded base 24*a* and the upper portion 24*b*. The lower edge of the stem 22 preferably rests against this shoulder 24*c*. A spacer collar 26 may be disposed in the central neck 16 having an outer diameter approximately the same as the diameter of the central neck 16 such that the fit between the two is tight. The stem nipple 24 and spacer collar 26 are preferably hollow cylinders providing continuous passages through each.

Figure 8:
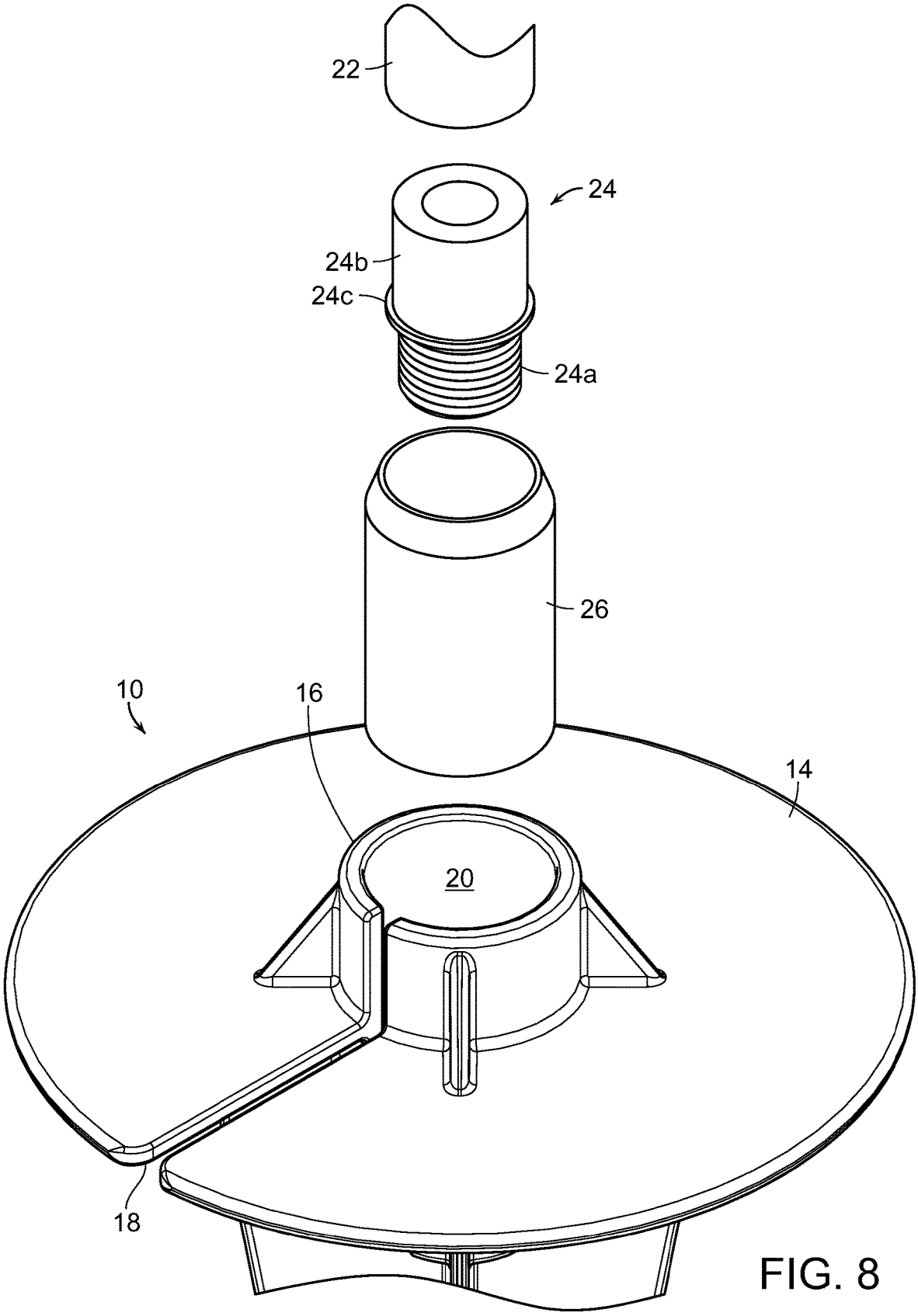
FIG. 8 is an exploded view of an inventive lighting stake according to the present invention illustrating assembly of the same.

FIG. 8 shows the stem 22, nipple 24, and collar 26 in the order in which they would be inserted into the central neck 16 of the stake 10. The stem nipple 24 preferably fits inside of the spacer collar 26 such that the threaded base 24*a* passes through an opening 26*a* in the bottom of the spacer collar 26. The shoulder 24*c* of the stem nipple 24 helps to secure the spacer collar 26 in the central neck 16. The upper portion 24*b* of the stem nipple 24 preferably has an outer diameter slightly smaller than both the shoulder 24*c* and the inner diameter of the spacer collar 26. This configuration leaves a small annular space 26*a* between the upper portion 24*b* and the spacer collar 26. This annular space 26*a* is preferably sized so as to receive the hollow collar 22*a* of the stem 22, and reliably and stably hold the light fixture on the stake 10.

Figure 9A:
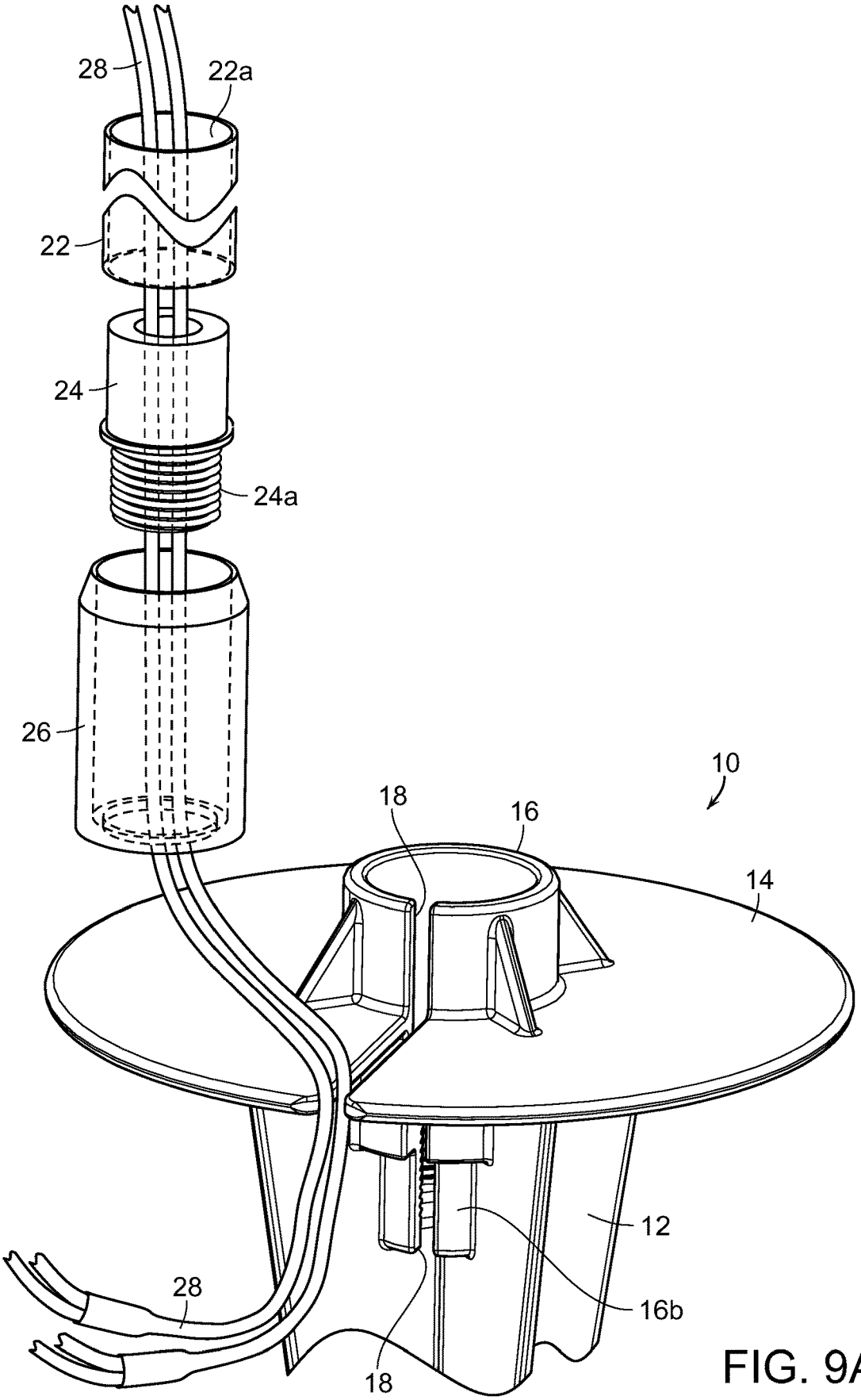
FIG. 9A is a close-up, perspective view of a step in assembling a light fixture with an inventive lighting stake according to the present invention.

FIGS. 9A-9D illustrate a method for assembling the inventive lighting stake 10 with a stem 22 and electrical wires 28 from a light fixture (not shown). As shown in FIG. 9A, electrical wires 28 connected to the light fixture extend from the stem 22 and are passed through the stem nipple 24 and spacer collar 26, with the opposite end of the wires 28 connected to an electrical source (not shown). At this step, the wires 28 are shown as starting to be passed through the slotted opening 18.

Figure 9B:
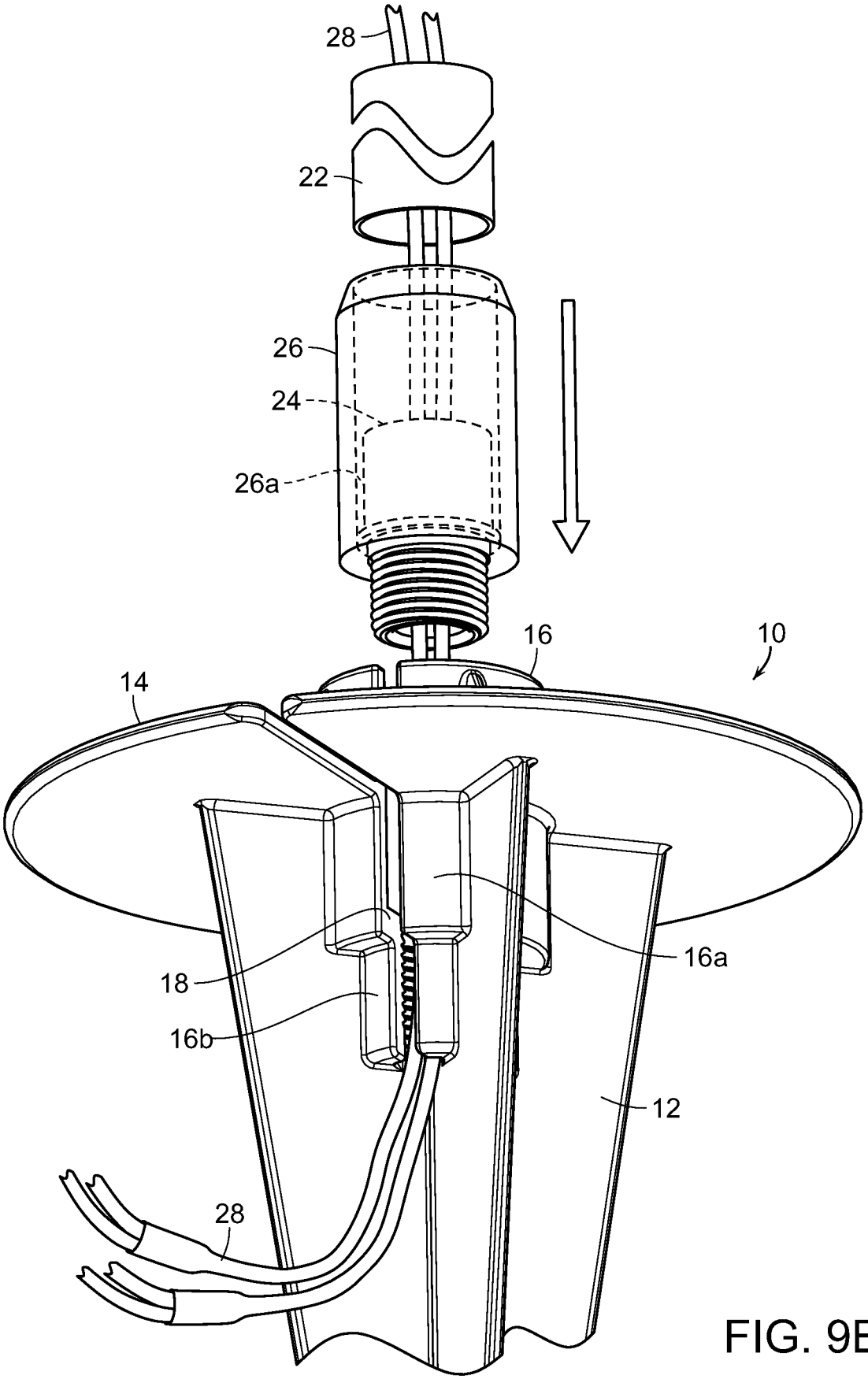
FIG. 9B is a close-up, perspective view of another step in assembling a light fixture with an inventive lighting stake according to the present invention.
Figure 9C:
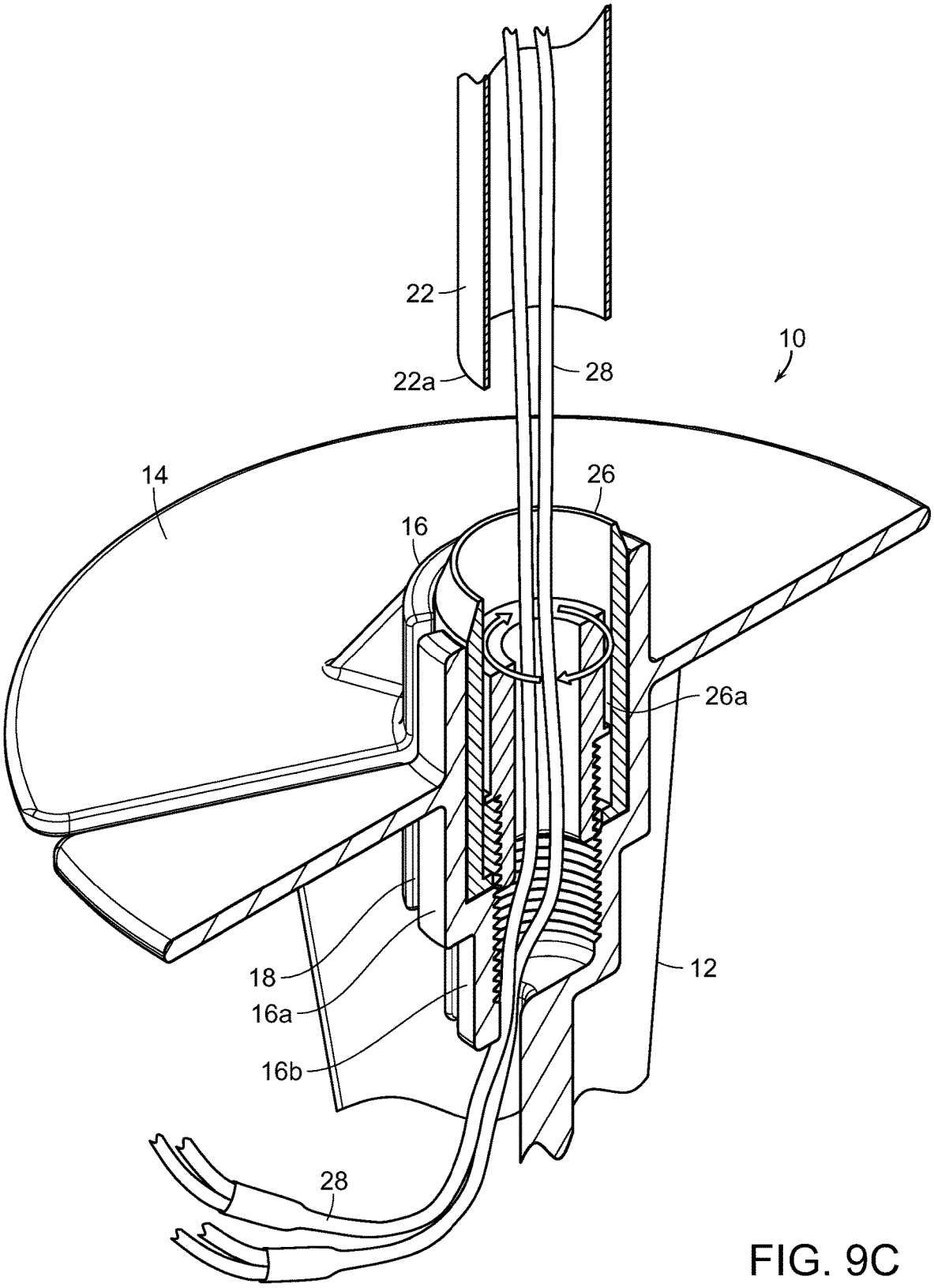
FIG. 9C is a close-up, perspective view of another step in assembling a light fixture with an inventive lighting stake according to the present invention.

In FIG. 9B, the electrical wires 28 have been passed completely through the slotted opening 18 from the outer edge of the base disk 14 to the central neck 16. Once completely through the slotted opening 18, the wires 28 traverse the pass-through opening 20 so that the stem 22 is above the base disk 14 and the wires 28 extend from an underside of the base disk 14. The spacer collar 26 is then inserted into the central neck 16 followed by the stem nipple 24 into the spacer collar 26. As indicated by the twisting arrow in FIG. 9C, the threaded base 24*a* is threaded into the lower portion 16*b* of the central neck 16. The shoulder 24*c* of the stem nipple 24 exerts force against an interior surface of the spacer collar 26 so as to securely retain the same within the central neck 16.

Figure 9D:
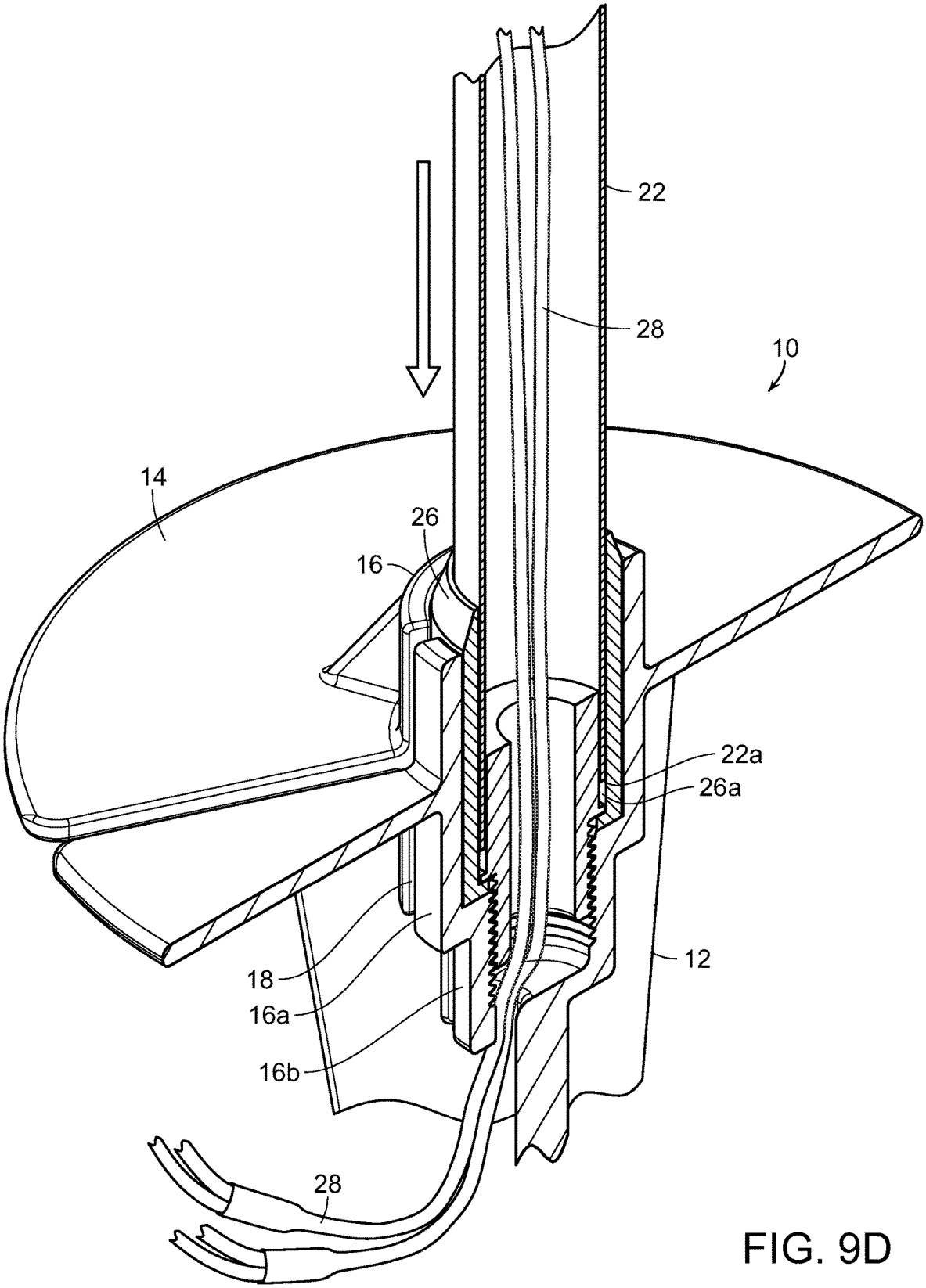
FIG. 9D is a close-up, perspective view of another step in assembling a light fixture with an inventive lighting stake according to the present invention.

At this point, as shown in FIG. 9D, the hollow collar 22*a* of the stem 22 is inserted into the annular gap 26*a* so as to securely hold the stem 22 in position relative to the lighting stake 10. Any slack in the wires 28 can be eliminated by pulling the wires 28 through the pass-through opening 20 from beneath the base disk 14. Once this assembly is completed, the lighting stake is ready to be placed into the ground or other substrate to support the light fixture.

The inventive stake 10 provides a mechanism whereby the stake 10 can be repaired or replaced without having to cut or disconnect any electrical wires 28. If, over time, the stake 10 breaks or otherwise becomes unusable, the stake can be removed without cutting the wires 28 or otherwise breaking any electrical connections by reversing the assembly steps described above. Once the stem 22, stem nipple 24, and spacer collar 26 are removed from the central neck 16, the wires 28 can be removed from the pass-through opening 20 by passing through the slotted opening 18. Then the entire assembly can be connected to a replacement stake 10 that is not broken or otherwise unusable.

Although various embodiments have been described in detail for purposes of illustration, various modifications may be made without departing from the scope and spirit of the invention.

What is claimed is:

1. A lighting device, comprising:

an elongated spike body having an upper end and a lower end, the lower end configured for insertion into a substrate;

a base disk affixed to the upper end of the spike body;

a hollow central neck defining a passageway through the base disk and a part of upper end of the spike body;

a slotted opening extending through the base disk and hollow central neck providing lateral access to the passageway;

a spacer collar removably disposed within the hollow central neck and a stem nipple removably affixed in the hollow central neck within the spacer collar, wherein the spacer collar and stem nipple define an annular space there between, wherein a stem body from a light fixture is received within the annular space.

2. The lighting device of claim 1, wherein the hollow central neck comprises an upper neck portion and a lower neck portion.

3. The lighting device of claim 2, wherein the lower neck portion is threaded.

4. The lighting device of claim 1, wherein the spike body comprises a plurality of ribs having a decreasing width from the upper end to a point at the lower end.

5. The lighting device of claim 4, wherein each of the plurality of ribs on the spike body comprises an offset proximate to the lower end that increases the width of each of the plurality of ribs before resuming the decreasing width.

6. A lighting device, comprising:

an elongated spike body having an upper end and a lower end, the lower end configured for insertion into a substrate;

a base disk affixed to the upper end of the spike body;

a hollow central neck comprising an upper neck portion and a lower neck portion defining a passageway through the base disk and a part of the upper end of the spike body;

a slotted opening extending through the base disk and hollow central neck providing lateral access to the passageway;

a spacer collar removably disposed within the hollow central neck;

a stem nipple coaxially disposed in the spacer collar and removably affixed in the lower neck portion, wherein the spacer collar and stem nipple define an annular space there between, wherein a stem body from a light fixture is received within the annular space.

7. The lighting device of claim 6, wherein the lower neck portion is threaded and the stem nipple has a threaded base configured for screwing engagement with the lower neck portion.

8. The lighting device of claim 6, wherein the spike body comprises a plurality of ribs having a decreasing width from the upper end to a point at the lower end.

9. The lighting device of claim 8, wherein each of the plurality of ribs on the spike body comprises an offset proximate to the lower end that increases the width of each of the plurality of ribs before resuming the decreasing width.

10. A lighting device, comprising:

an elongated spike body having an upper end and a lower end, the lower end configured for insertion into a substrate;

a base disk affixed to the upper end of the spike body;

a hollow central neck comprising an upper neck portion and a lower neck portion defining a passageway through the base disk and a part of the upper end of the spike body; wherein the lower neck portion is threaded;

a stem nipple having a threaded base configured for screwing engagement with the threaded lower neck portion and removably affixed therein;

a spacer collar disposed within the hollow central neck and coaxially disposed around the stem nipple, wherein the spacer collar and stem nipple define an annular space there between, wherein a stem body from a light fixture is received within the annular space; and a slotted opening extending through the base disk and hollow central neck providing lateral access to the passageway.

11. The lighting device of claim 10, wherein the spike body comprises a plurality of ribs having a decreasing width from the upper end to a point at the lower end.

12. The lighting device of claim 11, wherein each of the plurality of ribs on the spike body comprises an offset proximate to the lower end that increases the width of each of the plurality of ribs before resuming the decreasing width.

* * * * *